US009281639B2

(12) United States Patent
Yang et al.

(10) Patent No.: US 9,281,639 B2
(45) Date of Patent: Mar. 8, 2016

(54) MICRO RADIO-FREQUENCY CONNECTOR

(71) Applicant: Advanced-Connectek Inc., New Taipei (TW)

(72) Inventors: Sheng-Ho Yang, Tian-Jin (CN); Mei-Lan Li, New Taipei (TW); Xin Jin, Tian-Jin (CN); Yu-Le Su, Tian-Jin (CN)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/609,993

(22) Filed: Jan. 30, 2015

(65) Prior Publication Data

US 2015/0255934 A1 Sep. 10, 2015

(30) Foreign Application Priority Data

Mar. 5, 2014 (CN) ..... 2014 1 0077029

(51) Int. Cl.
*H01R 24/40* (2011.01)
*H01R 4/48* (2006.01)
*H01R 103/00* (2006.01)

(52) U.S. Cl.
CPC ..... *H01R 24/40* (2013.01); *H01R 4/48* (2013.01); *H01R 2103/00* (2013.01)

(58) Field of Classification Search
CPC ..... H01R 24/46
USPC ..... 439/63, 581, 188
See application file for complete search history.

(56) References Cited

U.S. PATENT DOCUMENTS 6,296,492 B1 * 10/2001 Fujimoto ..... H01R 13/6315 439/188
6,751,317 B2 * 6/2004 Shima ..... H01R 13/7033 379/438
7,217,137 B1 * 5/2007 Nakagawa ..... H01R 13/52 439/188
7,513,778 B1 * 4/2009 Dar-Shan ..... H01R 13/7033 439/188
7,632,123 B2 * 12/2009 Nakagawa ..... H01R 24/46 439/188
7,726,992 B2 * 6/2010 Wang ..... H01R 13/7033 439/188
7,794,253 B2 * 9/2010 Wang ..... H01R 24/46 439/188
8,011,939 B2 * 9/2011 Braem ..... H01R 13/2407 439/188
8,038,450 B2 * 10/2011 Nakagawa ..... H01R 24/50 439/188
8,066,516 B2 * 11/2011 Hoshiba ..... H01R 24/44 439/63
8,226,426 B2 * 7/2012 Wang ..... H01R 9/05 324/750.25
8,309,868 B2 * 11/2012 Tuin ..... H01R 24/46 200/51.1
8,444,422 B2 * 5/2013 Lin ..... H01R 24/46 439/188
8,535,074 B2 * 9/2013 Hirakawa ..... H01R 24/46 439/188
8,678,859 B2 * 3/2014 Hirakawa ..... H01R 4/028 439/188
8,727,798 B2 * 5/2014 Huo ..... H01R 13/703 439/188
8,920,181 B2 * 12/2014 Hida ..... H01R 13/703 439/188

(Continued)

*Primary Examiner* — Ross Gushi
(74) *Attorney, Agent, or Firm* — Alan D. Kamrath; Kamrath IP Lawfirm, P.A.

(57) ABSTRACT

A micro radio-frequency connector includes an isolated body, a resilient terminal and an external terminal. The isolated body includes an accommodating slot and an inserting hole connected to the accommodating slot. The accommodating slot includes an upper inner wall and a lower inner wall opposite to each other. The resilient terminal is disposed inside the accommodating slot, and includes a fixing section, two resilient arms and a first contacting section. The fixing section is fixed to the accommodating slot. An end of the resilient arm is connected to the fixing section and contacts against the lower inner wall, the other end of the resilient arm is a free end to be separated from the lower inner wall while an external force is not applied to the first contacting section and further to contact against the lower inner wall while the external force is applied to the first contacting section.

10 Claims, 9 Drawing Sheets

(56) References Cited

U.S. PATENT DOCUMENTS 8,986,043 B2 * 3/2015 Hirakawa ..... H01R 24/46 439/188
9,077,130 B2 * 7/2015 Hashimoto ..... H01R 13/7033
9,077,131 B2 * 7/2015 Hida ..... H01R 24/46
9,106,034 B2 * 8/2015 Tsai ..... H01R 24/46
2001/0050983 A1 * 12/2001 Shima ..... H01R 13/7033 379/188
2002/0034890 A1 * 3/2002 Uratani ..... H01R 24/46 439/188
2006/0128195 A1 * 6/2006 Chen ..... H01R 24/46 439/188
2007/0117435 A1 * 5/2007 Nakagawa ..... H01R 13/52 439/188
2010/0081308 A1 * 4/2010 Wang ..... H01R 13/7033 439/248
2010/0227481 A1 * 9/2010 Liao ..... H01R 24/46 439/63
2010/0248539 A1 * 9/2010 Nakagawa ..... H01R 24/50 439/578
2011/0159708 A1 * 6/2011 Huang ..... H01R 24/46 439/63
2012/0289084 A1 * 11/2012 Hirakawa ..... H01R 4/028 439/578
2012/0289085 A1 * 11/2012 Hirakawa ..... H01R 24/46 439/578
2013/0084739 A1 * 4/2013 Lin ..... H01R 24/46 439/578
2013/0102173 A1 * 4/2013 Hashimoto ..... H01R 13/7033 439/188
2013/0224991 A1 * 8/2013 Lee ..... H01R 13/52 439/519
2013/0224992 A1 * 8/2013 Hirakawa ..... H01R 24/46 439/578
2013/0303008 A1 * 11/2013 Hida ..... H01R 13/703 439/188
2013/0319834 A1 * 12/2013 Chen ..... H01H 9/02 200/295
2014/0065845 A1 * 3/2014 Ando ..... H01R 24/46 439/38
2014/0206216 A1 * 7/2014 Huang ..... H01R 24/46 439/188
2014/0227906 A1 * 8/2014 Hoshiba ..... H01R 24/46 439/578
2014/0287606 A1 * 9/2014 Hida ..... H01R 24/46 439/188
2015/0056866 A1 * 2/2015 Osaki ..... H01R 24/46 439/675
2015/0075953 A1 * 3/2015 Chen ..... H01R 24/46 200/51.09
2015/0108998 A1 * 4/2015 Osaki ..... G01R 31/04 324/538
2015/0162689 A1 * 6/2015 Matoba ..... H01R 24/46 439/581
2015/0214678 A1 * 7/2015 Chen ..... H01R 13/405 439/581
2015/0255934 A1 * 9/2015 Yang ..... H01R 24/40 439/578

* cited by examiner

MICRO RADIO-FREQUENCY CONNECTOR

BACKGROUND OF THE INVENTION

1. Field of the Invention

The present invention relates to a connector, and more particularly, to a micro radio-frequency connector which has a resilient terminal to apply force to a terminal of an external connecter while the resilient terminal contacts the terminal for providing preferred contact stability.

2. Description of the Prior Art

FIG. 7 to FIG. 9 respectively are an assembly diagram, an exploded diagram and a sectional view of a micro radio-frequency connector in the prior art. Please refer to FIG. 7 to FIG. 9, the micro radio-frequency connector includes an isolated body 10, a resilient terminal 50, an external terminal 30 and a fixing terminal 40. The isolated body 10 includes a base 11 and an inserting portion 12. An accommodating slot 13 is formed inside the base 11. The inserting portion 12 stretches from the base 11 upwardly, and an inserting hole 14 is formed inside the inserting portion 12 and connected to the accommodating slot 13. The accommodating slot 13 includes an upper inner wall 131 adjacent by the inserting hole 14, and a lower inner wall 132 opposite to the upper inner wall 131. The external terminal 30 includes a slab body 31, a tube portion 32, a piercing hole 33 and two welding portions 34. The slab body 31 is disposed on a front 111 of the base 11, and the welding portions 34 are respectively disposed on two sides of the slab body 31. The two welding portions 34 respectively buckle with the base 11 and stretch toward a back 112 of the base 11. The tube portion 32 stretches from the slab body 31 upwardly. The piercing hole 33 is formed through the slab body 31 and the tube portion 32, and can be inserted by the inserting portion 12 of the isolated body 10.

The resilient terminal 50 is disposed inside the accommodating slot 13, and includes a fixing section 51, two resilient arms 52, a first contacting section 53, a welding section 54 and a second contacting section 55. The fixing section 51 is fixed to the accommodating slot 13. The resilient arms 52 stretch from the fixing section 51, and the second contacting section 55 is connected between ends of the two resilient arms 52. An end 531 of the first contacting section 53 is connected to the second contacting section 55, and the other end 532 of the first contacting section 53 is a free end to contact against the lower inner wall 132 of the accommodating slot 13. The welding section 54 protrudes from the base 11 and stretches toward the back 112 of the base 11. The fixing terminal 40 includes a contact piece 41 and a welding piece 42. The contact piece 41 is disposed on the upper inner wall 131 of the accommodating slot 13. The welding piece 42 protrudes from the base 11 and stretches toward the back 112 of the base 11.

As an external connector (not shown in figures) is not connected to the micro radio-frequency connector, the second contacting section 55 of the resilient terminal 50 contacts the contact piece 41 of the fixing terminal 40 to electrically connect the resilient terminal 50 with the fixing terminal 40. As the external connector is connected to the micro radio-frequency connector, a tube terminal of the external connector is engaged with the tube portion 32 of the external terminal 30, and a pillar terminal of the external connector passes through the inserting hole 14 on the accommodating slot 13 to press the first contacting section 53 of the resilient terminal 50, and the second contacting section 55 is moved downwardly to be separate from the contact piece 41 of the fixing terminal 40. The resilient terminal 50 is electrically connected to the pillar terminal of the external connector instead of electrically connecting to the fixing terminal 40.

The two resilient arms 52 of the resilient terminal 50 are cantilever beams to provide two resilient fulcrums in position closed to the fixing section 51, and the end 532 of the first contacting section 53 provides another resilient fulcrum by contacting against the lower inner wall 132 of the accommodating slot 13. The foresaid resilient fulcrums are closed to the fixing section 51, which results in non-uniform force applied to the resilient terminal 50 by pressure of the pillar terminal of the external connector, contact between the resilient terminal 50 and the external connector is unstable because the resilient terminal 50 accordingly applies the non-uniform force to the pillar terminal of the external connector, and stability of the signal transmission is decreased or the signal transmission is failed. In addition, the micro radio-frequency connector is small-size, the two resilient arms 52 may be deformed over tolerance to generate metal fatigue or permanent deformation onto local regions of the resilient arms 52 due to the small resilient arms 52 of the resilient terminals 50, so contact between the resilient terminal 50 and the external connector is unstable and serviceable life of the micro radio-frequency connector is decreased.

SUMMARY OF THE INVENTION

The present invention provides a micro radio-frequency connector which utilizes a resilient terminal to provide uniform force while being pressed by a terminal of an external connector so as to increase contact stability for solving above drawbacks.

According to the claimed invention, a micro radio-frequency connector includes an isolated body, a resilient terminal and an external terminal. The isolated body includes a base and an inserting portion. An accommodating slot is formed inside the base. The inserting portion stretches from the base upwardly, and an inserting hole is formed inside the inserting portion and connected to the accommodating slot. The accommodating slot includes an upper inner wall adjacent to the inserting hole and a lower inner wall opposite to the upper inner wall. The resilient terminal is disposed inside the accommodating slot. The resilient terminal includes a fixing section, two resilient arms and a first contacting section. Each of the resilient arms is an arc structure and an arc region of the resilient arm facing downwardly. The fixing section is fixed to the accommodating slot. An end of the resilient arm is connected to the fixing section and contacts against the lower inner wall, the other end of the resilient arm is a free end and adapted to be separated from the lower inner wall while an external force is not applied to the first contacting section and further to contact against the lower inner wall while the external force is applied to the first contacting section. The first contacting section is connected between the two resilient arms and located under the inserting hole. The external terminal covers the isolated body.

According to the claimed invention, the fixing section is disposed on the lower inner wall, a plurality of engaging protrusions stretches from the fixing section upwardly and contacts against the upper inner wall.

According to the claimed invention, a sunken slot is formed on the first contacting section and adapted to contact a terminal of an external connector.

According to the claimed invention, the resilient terminal further includes a welding section protruding from the base and stretching to a back of the base.

According to the claimed invention, the micro radio-frequency connector further includes a fixing terminal, and the fixing terminal includes a contact piece disposed on the upper inner wall. The resilient terminal further includes a second contacting section stretching from the first contacting section toward a direction away from the fixing section. The second contacting section contacts against the contact piece while the external force is not applied to the first contacting section, and is separated from the contact piece while the external force is applied to the first contacting section.

According to the claimed invention, the resilient terminal further includes a welding section. The fixing terminal further includes a welding piece, and the welding section and the welding piece respectively protrude from the base and stretch to a back of the base.

According to the claimed invention, a plurality of contacting protrusions stretches from the second contacting section upwardly and is adapted to contact against the contact piece.

According to the claimed invention, the resilient terminal further includes a resilient section, an end of the resilient section is connected to the first contacting section, and the other end of the resilient section is a free end to contact against the lower inner wall.

According to the claimed invention, the external terminal includes a slab body, a tube portion and a piercing hole, the slab body is disposed on a front of the base, the tube portion stretches from the slab body upwardly, the piecing hole is formed through the slab body and the tube portion to be inserted by the inserting portion.

According to the claimed invention, welding portions are respectively formed on two sides of the slab body to engage with the base and to stretch toward a back of the base.

It is remarked that the above mentioned aspects or features can also be combined with each other and are in the scope of the present invention as well.

The resilient terminal of the micro radio-frequency connector of the present invention provides two resilient fulcrums on ends of the resilient arms adjacent to the fixing section and further two resilient fulcrums on the other ends of the resilient arms away from the fixing section according to dome structure formed by the resilient arms and the first contacting section. The resilient terminal further provides one resilient fulcrum on the other end of the resilient section contacting the lower inner wall of the accommodating slot. The resilient fulcrums are distributed uniformly, and the resilient terminal is uniformly forced by the pillar terminal of the external connector, so as to provide uniform force from the resilient terminal to the pillar terminal of the external connector. Contact stability and signal transmission stability are accordingly increased. Design of the dome structure can decrease its deformation to prevent the local region from metal fatigue or permanent deformation, so as to increase its serviceable life.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
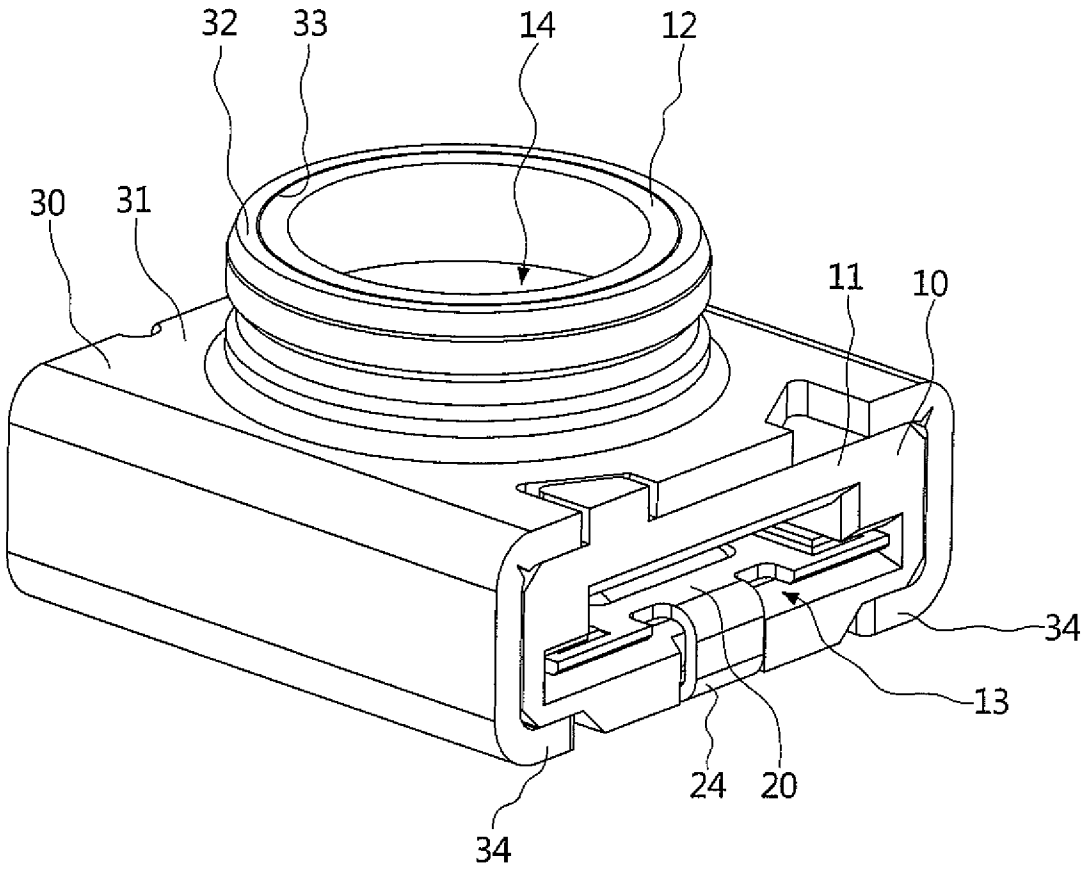
FIG. 1 and FIG. 2 respectively are assembly diagrams of a micro radio-frequency connector in different views in the present invention.
Figure 2:
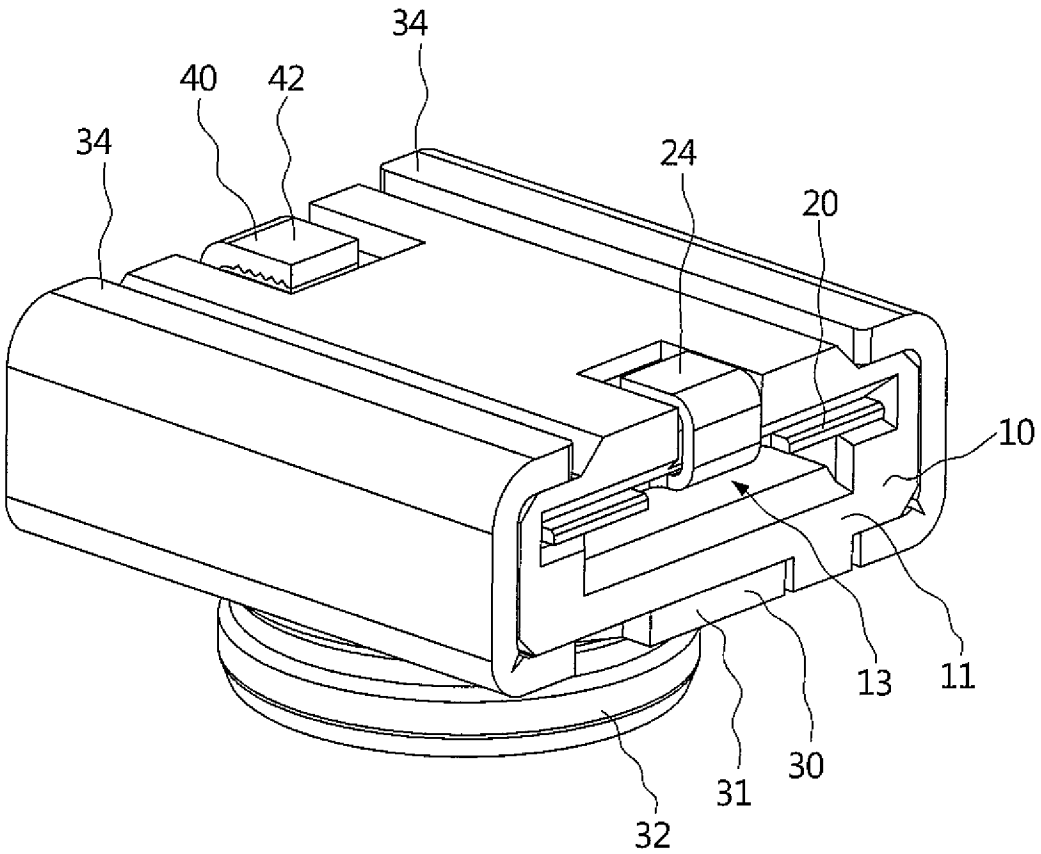
Figure 3:
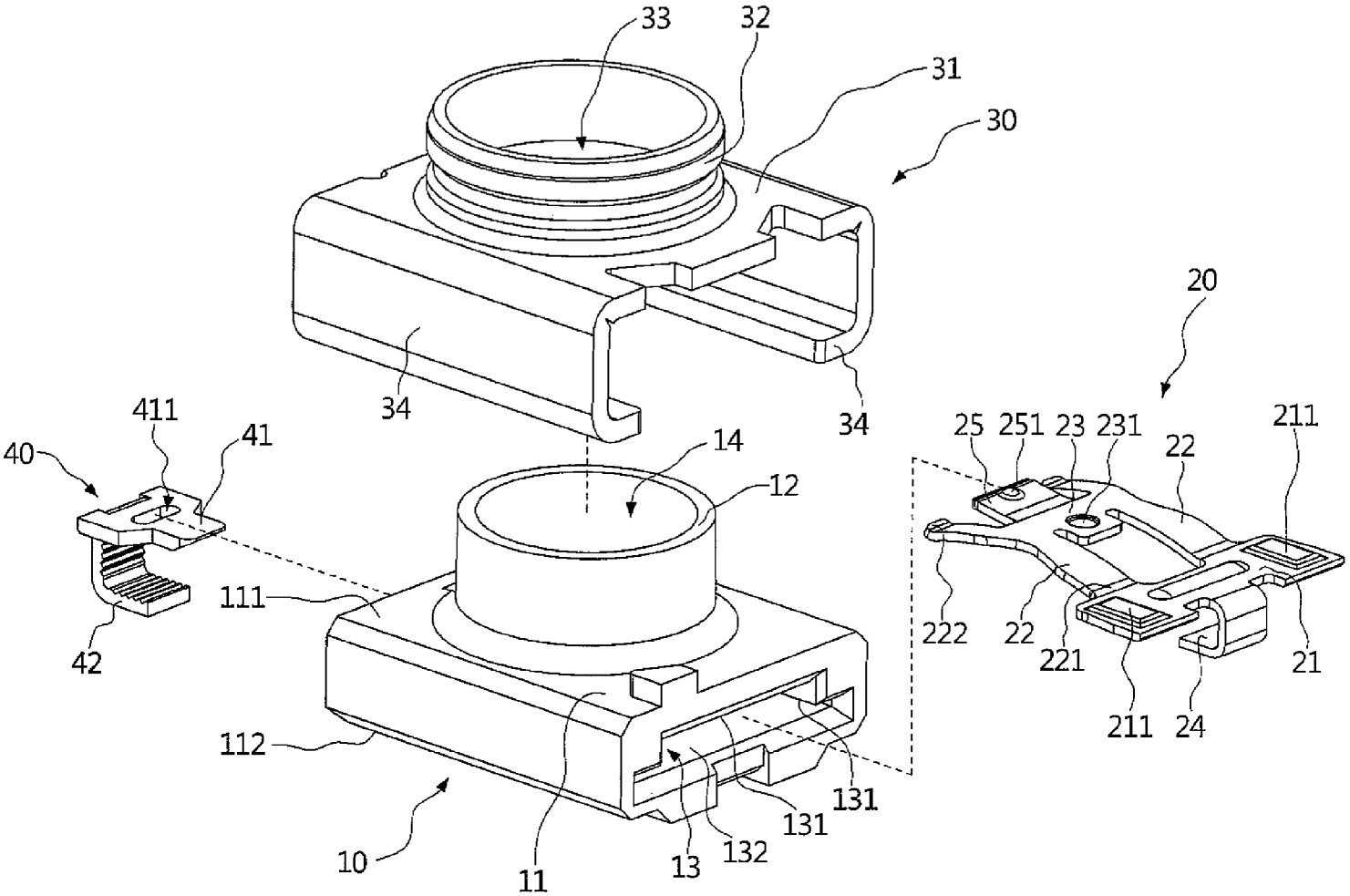
FIG. 3 and FIG. 4 respectively are exploded diagrams of the micro radio-frequency connector in different views in the present invention.

Wherever possible, same or similar reference numerals are used in the drawings and the description to refer to the same or like parts or steps. In addition, directional terms, such as upwardly, downwardly, on, under, front, and back may be used with respect to the drawings. These and similar directional terms should not be construed to limit the scope of the present invention in any manner.

Please refer to FIG. 1 to FIG. 5. The micro radio-frequency connector of the present invention includes an isolated body 10, a resilient terminal 20, an external terminal 30 and a fixing terminal 40. The isolated body 10 includes a base 11 and an inserting portion 12. An accommodating slot 13 is formed inside the base 11. The inserting portion 12 stretches from the base 11 upwardly, and an inserting hole 14 which is connected to the accommodating slot 13 is formed inside the inserting portion 12. The accommodating slot 13 includes an upper inner wall 131 adjacent by the inserting hole 14, and a lower inner wall 132 opposite to the upper inner wall 131. The external terminal 30 includes a slab body 31, a tube portion 32, a piercing hole 33 and two welding portions 34. The slab body 31 is disposed on a front 111 of the base 11. The two welding portions 34 are respectively disposed on two sides of the slab body 31. The two welding portions 34 respectively buckle with the base 11, and stretch toward a back 112 of the base 11 for welding onto a circuit board (not shown in figures). The tube portion 32 stretches from the slab body 31 upwardly. The piercing hole 33 is formed through the slab body 31 and the tube portion 32, and can be inserted by the inserting portion 12 of the isolated body 10. Therefore, the external terminal 30 covers the isolated body 10.

Figure 4:
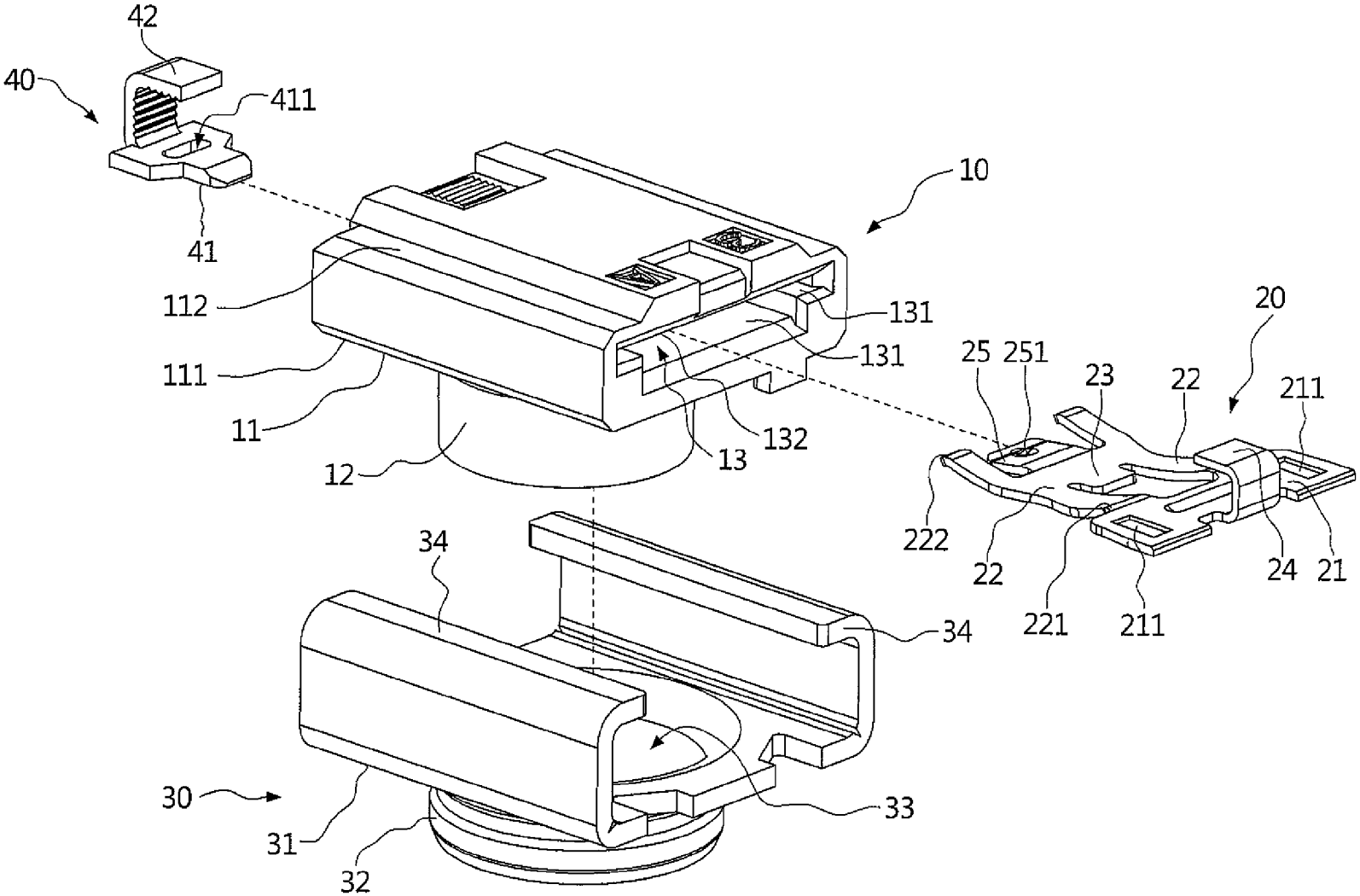
Figure 5:
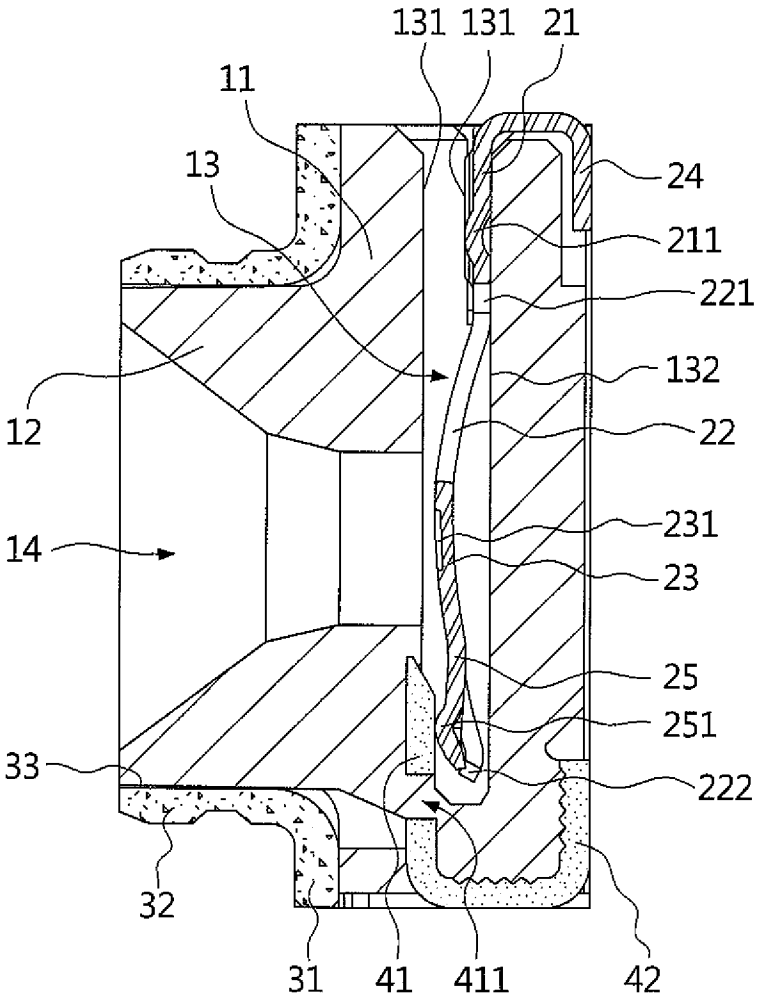
FIG. 5 is a lateral view of the micro radio-frequency connector in the present invention.

The resilient terminal 20 is disposed inside the accommodating slot 13. The resilient terminal 20 includes a fixing section 21, two resilient arms 22, a first contacting section 23, a welding section 24 and a second contacting section 25. The resilient arm 22 is an arc structure, and an arc region of the resilient arm 22 faces downwardly. The fixing section 21 is fixed on the accommodating slot 13. In this embodiment, the fixing section 21 is disposed on the lower inner wall 132 of the accommodating slot 13, and a plurality of engaging protrusions 211 stretches from the fixing section 21 upwardly to tightly contact against the upper inner wall 131 of the accommodating slot 13, so as to prevent the fixing section 21 from accidental separation/movement. An end 221 of the resilient arm 22 is connected to the fixing section 21 and contacts against the lower inner wall 132 of the accommodating slot 13. The other end 222 of the resilient arm 22 is a free end. While an external force is not applied to the first contacting section 23 (as shown in FIG. 4), the other end 222 of the resilient arm 22 is separated from the lower inner wall 132 of the accommodating slot 13. While the external force is applied to the first contacting section 23, the other end 222 of the resilient arm 22 contacts against the lower inner wall 132 of the accommodating slot 13. The first contacting section 23 is connected between the two resilient arms 22 and located under the inserting hole 14. In this embodiment, a sunken slot 231 is formed on the first contacting section 23 and adapted to contact a terminal of the external connector (not shown in figures), so as to increase contact stability between the first contacting section 23 and the terminal of the external connector. The welding section 24 passes through the base 11 and stretches toward the back 112 of the base 11, and can be welded on the circuit board. The second contacting section 25 stretches from the first contacting section 23 and points toward a direction away from the fixing section 21. In the embodiment, a plurality of contacting protrusions 251 stretches from the second contacting section 25 upwardly, to increase the contact stability between the second contacting section 25 and the fixing terminal 40. The fixing terminal 40 includes a contact piece 41 and a welding piece 42. The contact piece 41 is disposed on the upper inner wall 131 of the accommodating slot 13. The welding piece 42 passes through the base 11 and stretches toward the back 112 of the base 11, and can be welded on the circuit board.

According to a dome structure formed by the two resilient arms 22 and the first contacting section 23, the two resilient arms 22 not only utilize the ends 221 adjacent to the fixing section 21 to provide two resilient fulcrums, but also utilize the other ends 222 distant from the fixing section 21 to provide another two resilient fulcrums. The resilient fulcrums are uniformly distributed, so the force can be uniformly applied to the resilient terminal 20 while being pressed by the external connector, and the resilient terminal 20 applies the uniform force to the terminal of the external connector to increase the contact stability and signal transmission stability. In addition, deformation of the resilient terminal 20 can be accordingly decreased by design of the dome structure, so as to prevent local region from metal fatigue or permanent deformation, and to increase its serviceable life.

In this embodiment, the fixing terminal 40 is formed on the base 11 of the isolated body 10 in an injection molding manner. The contact piece 41 of the fixing terminal 40 passes through the accommodating slot 13 of the base 11 and is fixed on the upper inner wall 131 of the accommodating slot 13. The fixing terminal 40 further has a piercing hole 411 formed through the contact piece 41 to be inserted by a part of units insides the isolated body 10 for fixing its position. Further, the resilient terminal 20 inserts into an opening of the accommodating slot 13 formed on a lateral surface of the base 11 and is disposed inside the accommodating slot 13. The present invention is not limited by the above-mentioned embodiment, and depends on design demand. For example, The isolated body may mainly include an upper gum core and a lower gum core. The resilient terminal can be engaged with the lower gum core, the fixing terminal can be engaged with the upper gum core, and the upper gum core and the lower gum core are assembled to form the isolated body. The foresaid isolated body has an inside accommodating slot to accommodate the resilient terminal and the fixing terminal.

While the external connector is not electrically connected to the micro radio-frequency connector, the external force is not applied to the first contacting section 23 of the resilient terminal 20, the second contacting section 25 of the resilient terminal 20 contacts the contact piece 41 of the fixing terminal 40, and the resilient terminal 20 is electrically connected to the fixing terminal 40. Besides, the other end 222 of the resilient arm 22 is separated from the lower inner wall 132 of the accommodating slot 13. While the external connector is electrically connected to the micro radio-frequency connector, a tube terminal of the external connector is engaged with the tube portion 32 of the external terminal 30, and a pillar terminal of the external connector passes through the inserting hole 14 of the accommodating slot 13 to press the first contacting section 23 of the resilient terminal 20. The first contacting section 23 moves downwardly by the external force, the second contacting section 25 is driven to move downwardly to be separated from the contact piece 41 of the fixing terminal 40, and the resilient terminal 20 is electrically connected to the pillar terminal of the external connector instead of electrically connecting to the fixing terminal 40. The other end 222 of the resilient arm 22 may contact against the lower inner wall 132 of the accommodating slot 13 to provide the resilient fulcrum.

In an application of the micro radio-frequency connector, the external connector is connected to an end of an coaxial cable, the other end of the coaxial cable is connected to an antenna, and the resilient terminal 20 is connected to a radio-frequency processing circuit. When the external connector is connected to the micro radio-frequency connector, the antenna is electrically connected to the radio-frequency processing circuit via the external connector and the resilient terminal 20, and the radio-frequency processing circuit can receive a signal output from the antenna. In another application of the micro radio-frequency connector, the external connector is connected to a calibrating device, the resilient terminal 20 is connected to the radio-frequency processing circuit, and the fixing terminal 40 is connected to the antenna. When the external connector is not connected to the micro radio-frequency connector, the resilient terminal 20 is electrically connected to the fixing terminal 40 to electrically connect the antenna with the radio-frequency processing circuit, and the radio-frequency processing circuit can process the signal output from the antenna. When the external connector is connected to the micro radio-frequency connector, the resilient terminal 20 is not electrically connected to the fixing terminal 40, the calibrating device is electrically connected to the radio-frequency processing circuit by the external connector and the resilient terminal 20, and the calibrating device can be utilized to detect the radio-frequency processing circuit.

Figure 6:
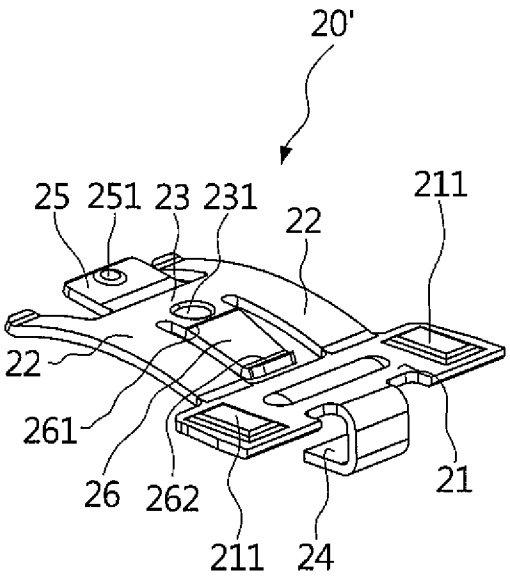
FIG. 6 is a top view of the micro radio-frequency connector resilient terminal according to another embodiment of the present invention.
Figure 7:
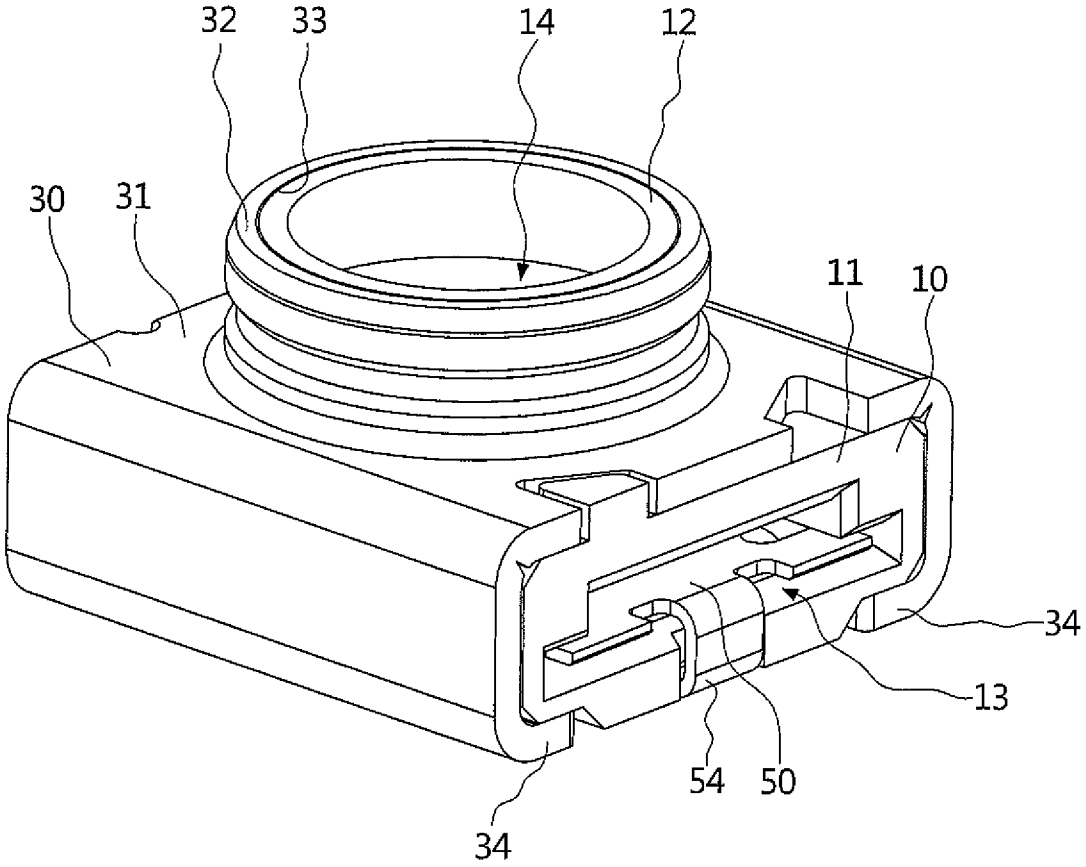
FIG. 7 to FIG. 9 respectively are an assembly diagram, an exploded diagram and a sectional view of a micro radio-frequency connector in the prior art.
Figure 8:
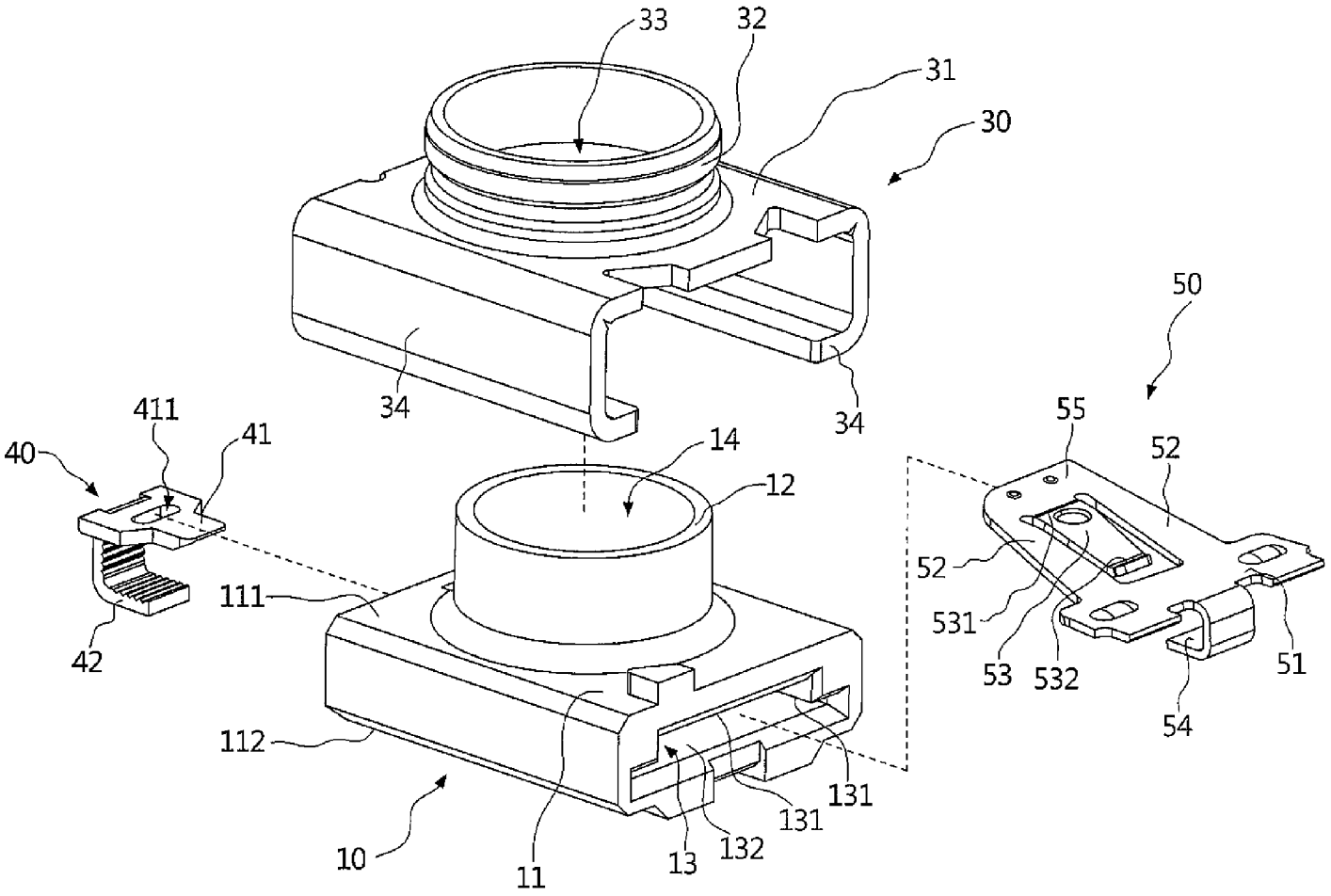
Figure 9:
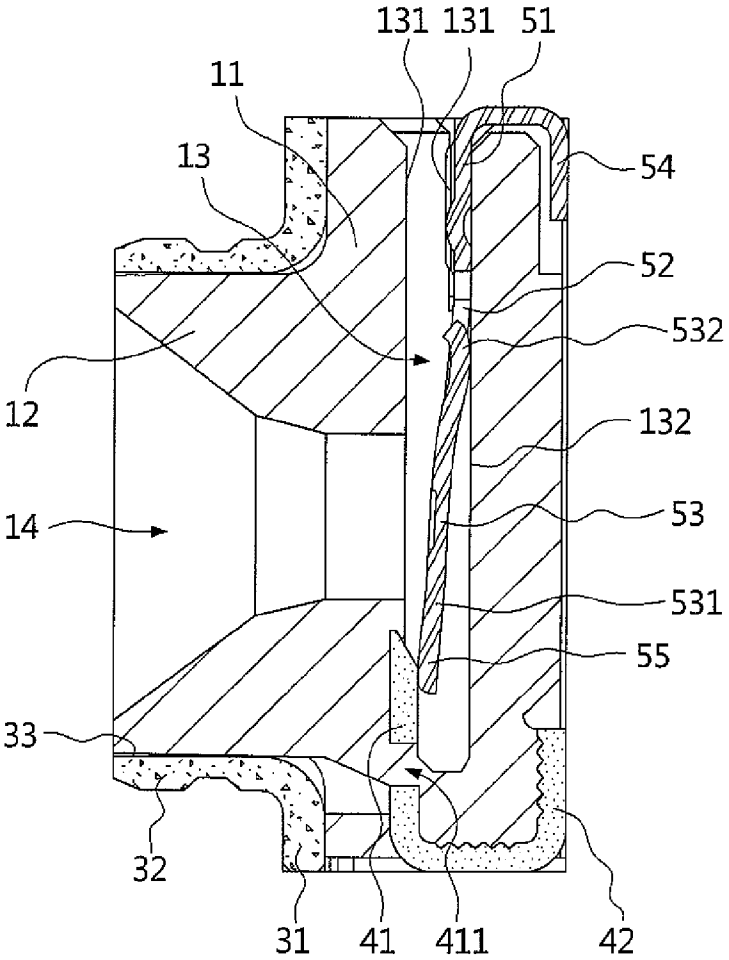

Please refer to FIG. 6, which is a top view of the micro radio-frequency connector resilient terminal according to another embodiment of the present invention. Comparing to the resilient terminal 20 shown in FIG. 3, the resilient terminal 20' shown in FIG. 6 further includes a resilient section 26. An end 261 of the resilient section 26 is connected to the first contacting section 23, and the other end 262 of the resilient section 26 is a free end to contact against the lower inner wall 132. The other end 262 of the resilient section 26 can provide a further resilient fulcrum for the micro radio-frequency connector.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A micro radio-frequency connector, comprising:

an isolated body, comprising a base and an inserting portion, an accommodating slot being formed inside the base, the inserting portion stretching from the base upwardly, an inserting hole being formed inside the inserting portion and connected to the accommodating slot, the accommodating slot comprising an upper inner wall adjacent to the inserting hole and a lower inner wall opposite to the upper inner wall;

a resilient terminal disposed inside the accommodating slot, the resilient terminal comprising a fixing section, two resilient arms and a first contacting section, each of the resilient arms being an arc structure and an arc region of the resilient arm facing downwardly, the fixing section being fixed to the accommodating slot, an end of the resilient arm being connected to the fixing section and contacting against the lower inner wall, the other end of the resilient arm being a free end and adapted to be separated from the lower inner wall while an external force is not applied to the first contacting section and further to contact against the lower inner wall while the external force is applied to the first contacting section, the first contacting section being connected between the two resilient arms and located under the inserting hole; and an external terminal covering the isolated body.

2. The micro radio-frequency connector of claim 1, wherein the fixing section is disposed on the lower inner wall, a plurality of engaging protrusions stretches from the fixing section upwardly and contacts against the upper inner wall.

3. The micro radio-frequency connector of claim 1, wherein a sunken slot is formed on the first contacting section and adapted to contact a terminal of an external connector.

4. The micro radio-frequency connector of claim 1, wherein the resilient terminal further comprises a welding section protruding from the base and stretching to a back of the base.

5. The micro radio-frequency connector of claim 1, wherein the micro radio-frequency connector further comprises a fixing terminal, the fixing terminal comprising a contact piece disposed on the upper inner wall, the resilient terminal further comprises a second contacting section stretching from the first contacting section toward a direction away from the fixing section, the second contacting section contacts against the contact piece while the external force is not applied to the first contacting section, and is separated from the contact piece while the external force is applied to the first contacting section.

6. The micro radio-frequency connector of claim 5, wherein the resilient terminal further comprises a welding section, the fixing terminal further comprises a welding piece, and the welding section and the welding piece respectively protrude from the base and stretch to a back of the base.

7. The micro radio-frequency connector of claim 5, wherein a plurality of contacting protrusions stretches from the second contacting section upwardly and is adapted to contact against the contact piece.

8. The micro radio-frequency connector of claim 1, wherein the resilient terminal further comprises a resilient section, an end of the resilient section is connected to the first contacting section, and the other end of the resilient section is a free end to contact against the lower inner wall.

9. The micro radio-frequency connector of claim 1, wherein the external terminal comprises a slab body, a tube portion and a piercing hole, the slab body is disposed on a front of the base, the tube portion stretches from the slab body upwardly, the piecing hole is formed through the slab body and the tube portion to be inserted by the inserting portion.

10. The micro radio-frequency connector of claim 9, wherein welding portions are respectively formed on two sides of the slab body to engage with the base and to stretch toward a back of the base.

* * * * *